US006677037B1

(12) United States Patent
Miller et al.

(10) Patent No.: US 6,677,037 B1
(45) Date of Patent: Jan. 13, 2004

(54) LASER SHOCK PEENING TAPE, METHOD AND ARTICLE

(75) Inventors: Mark Lloyd Miller, Schenectady, NY (US); Farzin Homayoun Azad, Clifton Park, NY (US); Seetha Ramaiah Mannava, Cincinnati, OH (US); Philemon Kennard Wright, III, Cincinnati, OH (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/660,967

(22) Filed: Sep. 13, 2000

(51) Int. Cl.[7] ..... C21D 1/09

(52) U.S. Cl. ..... 428/345; 428/356; 428/461; 428/515; 148/902; 148/512; 148/522; 148/525; 219/121.82; 219/121.66; 524/424; 524/441

(58) Field of Search ..... 428/345, 356, 428/461, 515; 148/903, 512, 522, 525; 219/121.82, 121.66; 524/424, 441

(56) References Cited

U.S. PATENT DOCUMENTS 4,237,514 A * 12/1980 Cline ..... 361/117
4,337,285 A * 6/1982 Akao et al. ..... 156/229
5,674,328 A 10/1997 Mannava et al. ..... 148/525
5,735,044 A 4/1998 Ferrigno et al. ..... 29/889.1
5,742,028 A 4/1998 Mannava et al. ..... 219/121.82
5,846,057 A 12/1998 Ferrigno et al. ..... 416/241 R
5,948,293 A 9/1999 Somers et al. ..... 219/121.85
5,951,790 A 9/1999 Mannava et al. ..... 148/510
6,005,219 A 12/1999 Rockstroh et al. ..... 219/121.48
6,049,058 A 4/2000 DuLaney et al. ..... 219/121.48
6,094,260 A 7/2000 Rochstroh et al. ..... 356/35.5
6,245,486 B1 * 6/2001 Teng ..... 101/450.1

* cited by examiner

*Primary Examiner*—D. Lawrence Tarazano
(74) *Attorney, Agent, or Firm*—Paul J. DiConza; Patrick K. Patnode

(57) ABSTRACT

An ablative tape is applied onto a substrate surface. The ablative tape comprises an ablative medium comprising a polymer and dispersed metallic component. The tape is then irradiated to ablate the ablative medium. An article comprises a substrate and the ablative tape applied to the substrate.

39 Claims, 6 Drawing Sheets

LASER SHOCK PEENING TAPE, METHOD AND ARTICLE

BACKGROUND OF THE INVENTION

This invention relates to laser shock peening of a part and to a tape, which includes an ablative medium for producing localized compressive residual stresses in the part.

Laser shock peening (LSP) is a process for producing a region of deep compressive residual stresses over a surface area of a work piece such as a part of a turbine engine. Laser shock peening typically uses multiple radiation pulses from high power lasers. The pulses or "hits" produce shock waves on the part surface. The part surface is generally coated with a paint or tape, which functions as an ablation material. Some amount of the ablation material vaporizes from contact with the laser beam. The rapid vaporization produces a shock wave which travels into the metal, creating compressive residual stress through plastic deformation. A confining medium can be employed to direct the shock waves into the part. The confining medium comprises a transparent layer of material such as a transparent plastic or a curtain of water. The LSP process creates compressive stresses in the part, which considerably increase resistance to fatigue failure.

Ablative tapes have been developed to provide the LSP ablation material. The tapes can comprise an adhesive layer on one side of an ablative layer. However, an ablative tape typically used in an LSP process can degrade during use. The degradation may be due to repeated pulses of the laser beam to the same tape area. Degradation of the tape results in "burn spots" and damage to the underlying part surface. The part can be repeatedly re-taped to prevent same area pulse damage. However, re-taping is time consuming, labor-intensive and costly.

There is need for an LSP tape process that requires decreased retaping. In addition, there is a need for an improved, resilient ablative tape for use in an LSP process.

SUMMARY OF THE INVENTION

The invention provides an improved ablative tape that withstands repeated application of laser pulses. The tape comprises an ablative medium comprising a polymer and dispersed metallic component.

In an embodiment, the invention relates to a method for treating a surface of a substrate. In the method, a tape is applied onto a substrate surface. The ablative tape comprises an ablative medium comprising a polymer and dispersed metallic component. The tape is then irradiated to ablate the ablative medium.

In another embodiment, the invention relates to an article, comprising a substrate and an ablative tape applied to the substrate. The ablative tape comprises a polymer and a dispersed metallic component.

DESCRIPTION OF THE INVENTION

Mannava et al., U.S. Pat. No. 5,674,328 teaches a method of laser shock peening a metallic part by firing a laser onto a surface of a work piece such as a turbine engine part, which has been adhesively covered by a tape having an ablative medium. The tape can be a self-adhering tape with a confinement medium, ablative layer and adhesive layer. Continuous movement is provided between the part and the laser beam while the laser beam is fired in repeated pulses onto the taped surface of the part. The pulses vaporize the ablative medium to form surface spots having deep compressive residual stresses that extend below the part surface. A confinement medium may be used to increase the depth of compressive residual stresses.

The present invention relates to an improved ablative medium for a tape that can be used in Mannava et al. and other LSP processes. The medium has an improved robustness that advantageously accommodates multiple overlapping LSP laser hits to the same area. Typical prior art media can withstand one hit (1×) or two hits (2×) at the most to the same area. As a result, a sequence of shocks must be carefully controlled or the part must be repeatedly retaped. The medium of the invention can sustain up to 4× hits and greater without degradation. The improved robustness of the inventive medium results in a substantial improvement in time, labor and cost of an LSP process.

These and other features will become apparent from the drawings and following detailed discussion, which by way of example without limitation describe preferred embodiments of the present invention.

Figure 1:
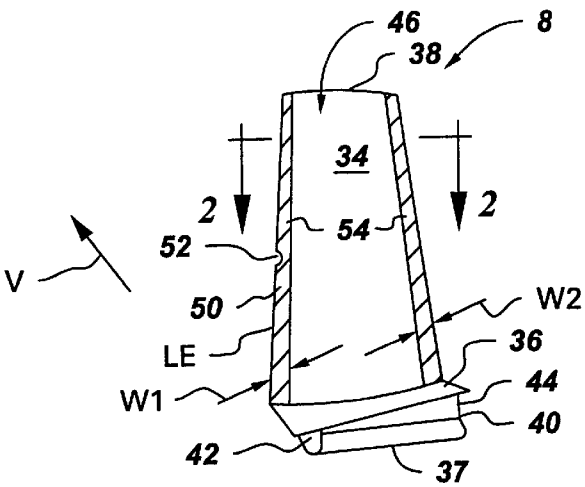
FIG. 1 is a perspective view of a fan blade to be processed.
Figure 2:
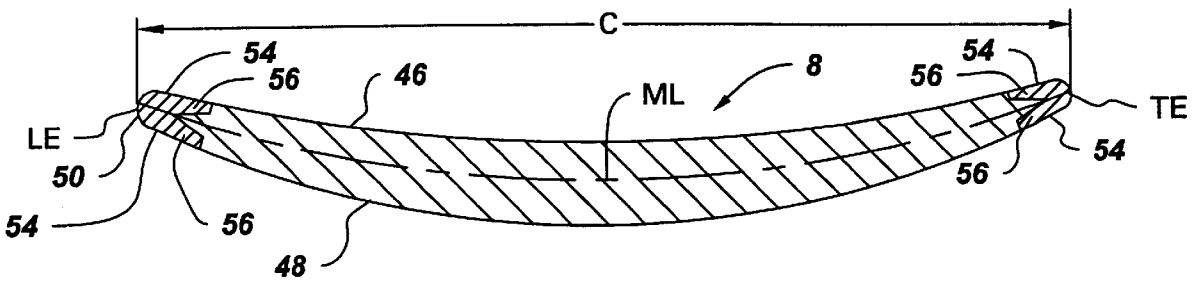
FIG. 2 is a cross-sectional view of the fan blade in FIG. 1.

FIGS. 1 and 2 illustrate a turbine engine fan blade 8 for laser shock peening (LSP) process, as embodied by the invention. The fan blade 8 is representative of various turbine components within the scope of the invention. The blade 8 forms a substrate for the LSP process. The substrate can be a superalloy, titanium alloy, steel or the like. As is known, the superalloy may comprise at least one of nickel-, cobalt-, or iron-based materials.

The fan blade 8 is in an as-mounted position in a turbine. The fan blade 8 comprises an airfoil 34 that extends radially outward from a blade platform 36 to a blade tip 38. The fan blade 8 also comprises a root section 40 that extends radially inward from platform 36 to a radially inward 37. A blade root 42 is connected to the platform 36 by a blade shank 44. The airfoil 34 extends in a chordwise direction between a leading edge, LE, and trailing edge, TE, of the airfoil 34.

A chord, C, of the airfoil 34 is a line between the leading edge and the trailing edge at each cross-section, as illustrated in FIG. 2. A pressure side 46 of the airfoil 34 is disposed to generally face a rotation direction, as indicated by arrow V (FIG. 1). A suction side 48 is disposed on the other side of the airfoil 34. A mean-line, ML is defined to generally extend midway between faces in a chordwise direction.

The fan blade 8 further comprises a leading edge section 50, which extends along the airfoil 34 and the blade platform 36 to the blade tip 38. The leading edge 50 includes a first width, W1, that comprises nicks 52. Such nicks 52 are generally formed during use of the fan blade 8. The nicks 52 undesirably act as high cycle fatigue stress risers, from which cracks can propagate through the fan blade 8. Crack propagation is due to tensile stress fields generated from centrifugal forces and vibration during engine operation, which can lead to undesirable turbine component operation and possible turbine component failure. The pressure side 46 and suction side 48 comprise laser shock peened surfaces 54. Regions 56 exhibit deep compressive residual stresses. The regions 56 can be coextensive with the leading edge section 50 in a chordwise direction with the width W1.

Figure 3:
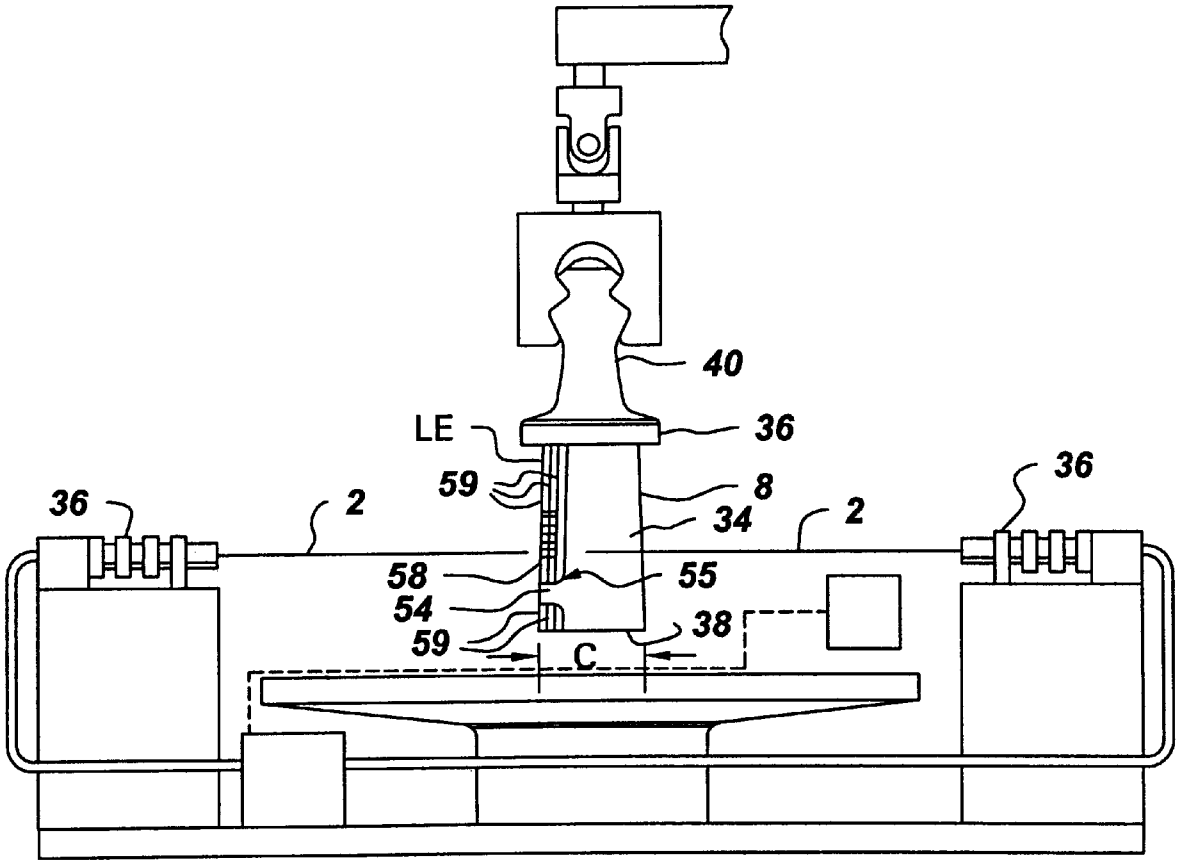
FIG. 3 is a schematic perspective view of the blade of FIG. 1 taped and mounted in a laser shock peening system.
Figure 4:
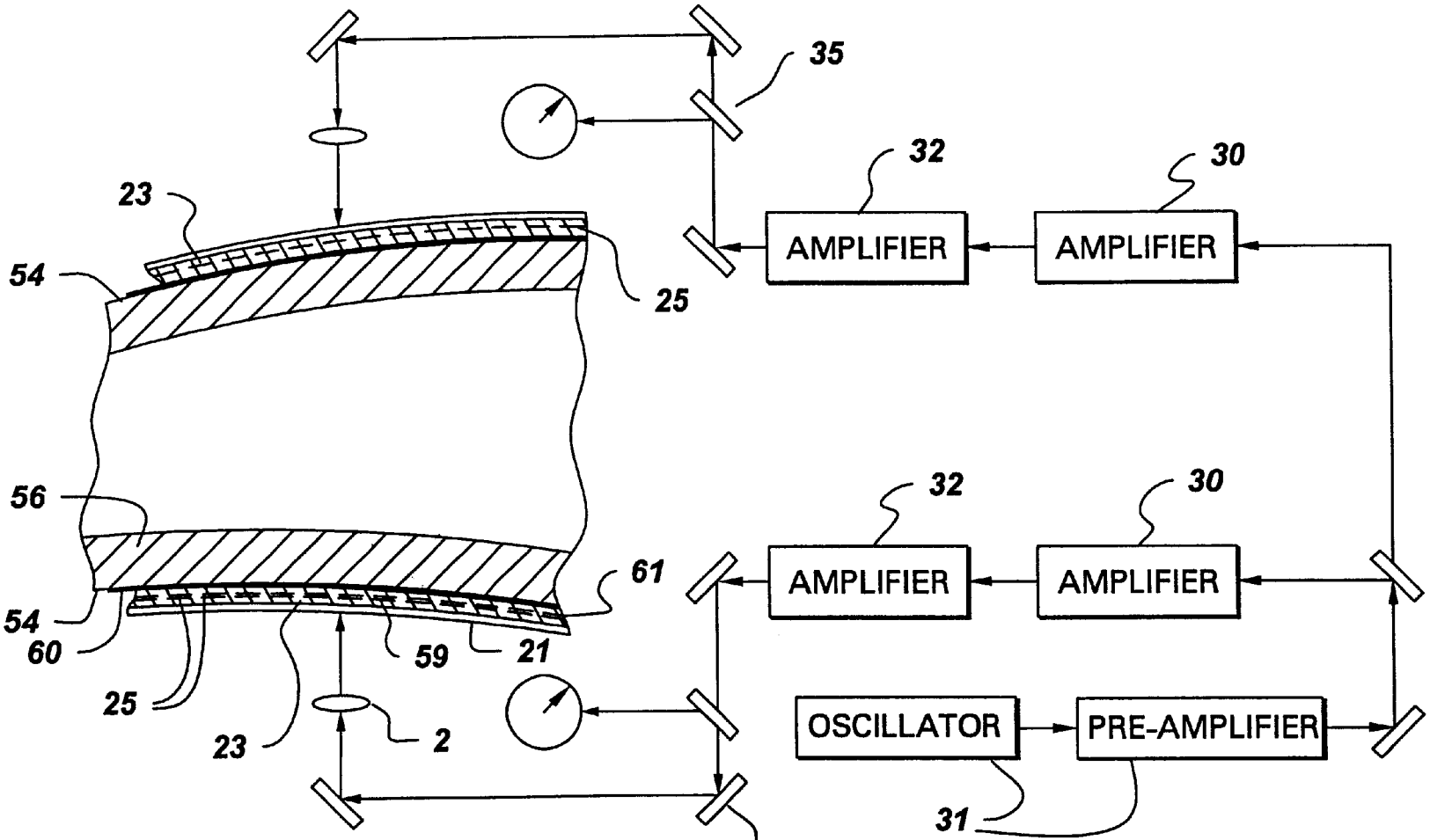
FIG. 4 is a partial cross-sectional and a partial schematic view of the setup in FIG. 3.

FIG. 3 is a schematic perspective view of the blade of FIG. 1 taped and mounted in a laser shock peening system and FIG. 4 is a partial cross-sectional and a partial schematic view of the setup in FIG. 3. Referring to FIGS. 3 and 4, the fan blade 8 is shown mounted in a position to effect laser shock peening. The laser shock peening system comprises a generator 31 having an oscillator and a pre-amplifier, and a beam splitter, which feeds the pre-amplified laser beam into two beam optical transmission circuits. Each optical transmission circuit may comprise first and second amplifiers 30 and 32 and appropriate optics 35 to transmit and focus laser beam 2 onto ablative tape 59.

Ablative tape 59 comprises an ablative medium 61 according to the invention. The ablative medium 61 comprises a polymer 23 and a dispersed metallic component 25. "Dispersed" in this application means widely spread through the polymer and does not necessarily mean (although it includes) finely divided or colloidal sized particles in the polymer. In fact, the metallic component can be in any form including in the form of a flake, particle, aggregate, film or layer. The term "metallic component" comprises metals in elemental form, alloys, molecules, other suitable metallic forms and combinations thereof with non-metallic components.

Preferred metallic components are substantially opaque and are capable of being ionized to a plasma. These pigments include magnesium, calcium, strontium, zinc, titanium, scandium and other transition metal elements and compounds. Most preferred are elemental aluminum, aluminum alloys and aluminum compounds.

The polymer of the ablative medium can comprise a thermoplastic polymer, such as a polyolefin. Preferably the polymer is a polypropylene, polyethylene polymer or copolymer thereof.

The metallic component can be provided in the ablative medium in any amount, for example in an amount up to about 6 weight %. Further, in a preferred embodiment the ablative medium can additionally comprise carbon in an amount of not less than about 1 weight %. In one embodiment, the ablative composition comprises aluminum and carbon. The carbon can be present as a carbon black or other forms of elemental carbon. In this embodiment, the ablative medium can comprise about 1 to about 15 weight % aluminum and about 1 to about 15 weight % carbon. Desirably in this embodiment, the medium comprises about 3 to about 10 weight % aluminum and about 3 to about 8 weight % carbon and preferably about 5 to about 8 weight % aluminum and about 4 to about 6 weight % carbon.

Also, a confinement medium 21 and an adhesive 60 can be included along with the ablative medium 61, as illustrated in FIG. 4. The confinement medium 21 is generally transparent to the laser frequency. The medium provides a containment of the shock waves upon ablation of the ablative medium 61 by maintaining high plasma pressures for a period long enough to generate plastic deformation in the metal. While illustrated as a layer, the confinement medium 21 can comprise a curtain of flowing water or a separate sheet of clear confinement material. An adhesive 60 can be provided as a component of the ablative tape 59 or an adhesive can be separately applied to the tape prior to application of the tape to a part in preparation for LSP. Or an adhesive layer can be separately applied directly onto the substrate over which the tape is adhered.

Figure 7:
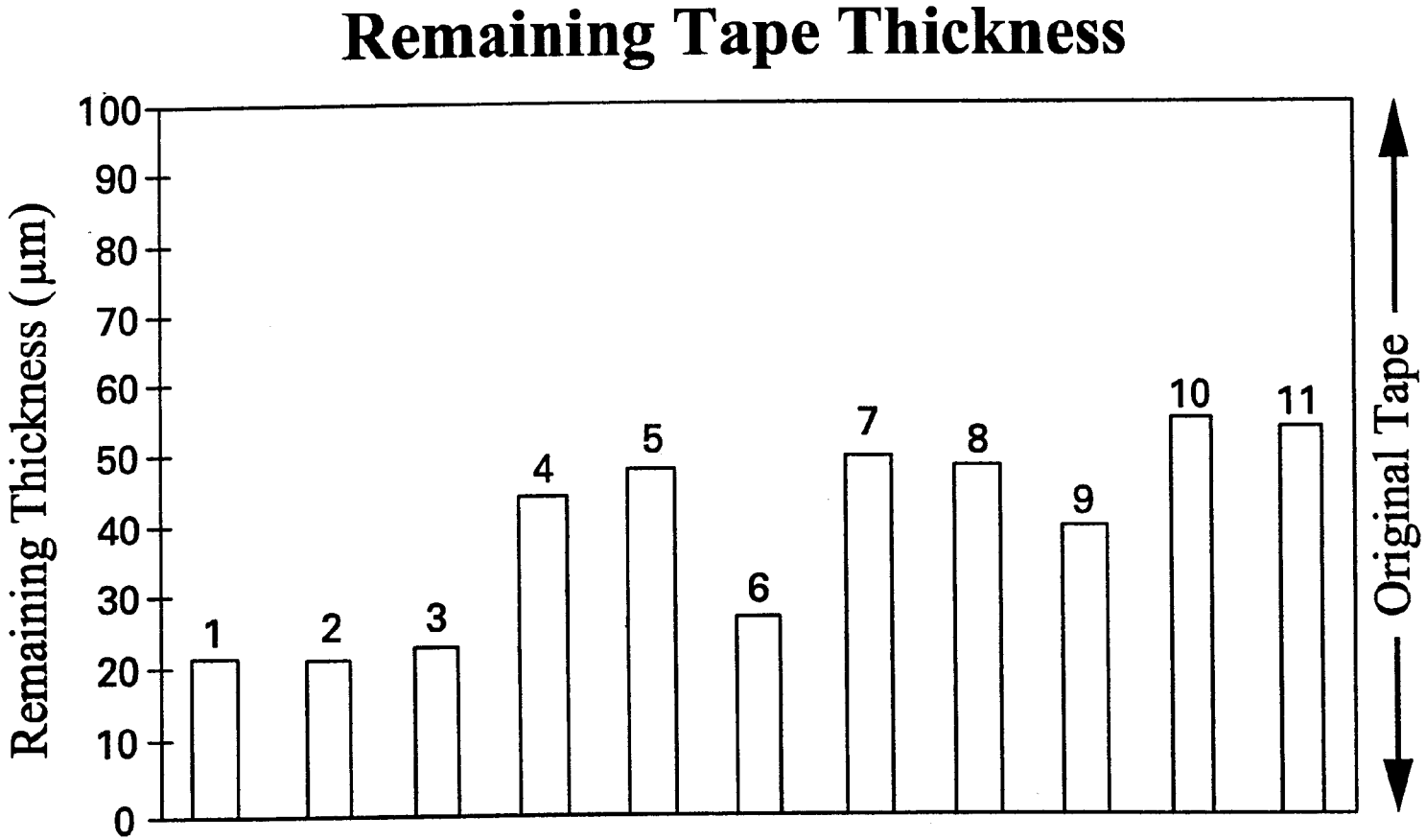
FIG. 7 is a graph showing the remaining thickness of tapes (remaining tape thickness after several laser pulse applications).

The ablative tape 59, as described, has special use as a tape in laser shock peening (LSP) as described herein, where a same surface area is repeatedly ablated. The inclusion of the metallic component reduces depth of vaporization and thinning of tape material that can occur during repeated laser shock in the same spot. As illustrated in FIG. 7, a higher percentage of the ablative medium thickness remains after repeated irradiation by the laser.

The ablative tape 59, as embodied by the invention, can find desirable applications for use in laser shock peening (LSP) where a same surface area is repeatedly ablated. The inclusion of metallic elements, such as, but not limited to, aluminum, and aluminum and carbon, can reduce a depth of vaporization or removal of the tape material by the laser. In other words, a higher percentage of the tape's thickness remains after repeated irradiation by a laser.

Referring again to FIGS. 3 and 4, the laser beam 2 that is used in the LSP, typically exhibits a peak power density on the order of magnitude of a gigawatt/cm$^2$. The laser beam 2 can be fired through a transparent confinement medium, as discussed above, for example through one of a transparent layer and a curtain of flowing water. The ablative medium will be ablated to generate plasma. The plasma results in shock waves on the surface of the material. These shock waves are then redirected toward the underlying substrate by the confinement medium. Thereafter, the shock waves penetrate the substrate. The amplitude and quantity of the shock waves can determine the depth and intensity of the residual compressive stresses. Accordingly, the ablative tape 59 can protect the target surface of the substrate and assist in the generation of plasma.

Figure 5:
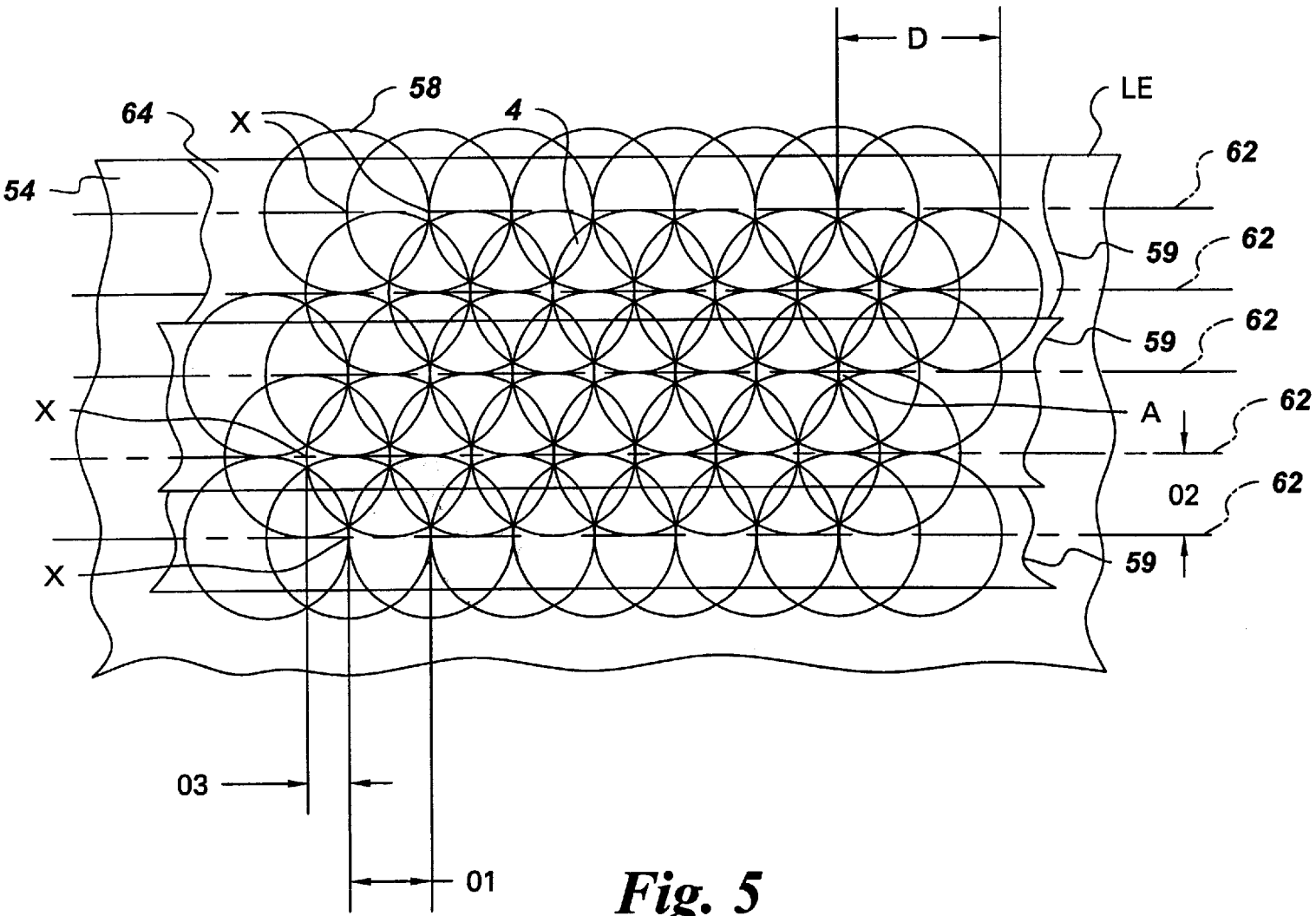
FIG. 5 is a schematic illustration of a pattern of laser shock peen circular spots on a laser shock peen surface.
Figure 6:
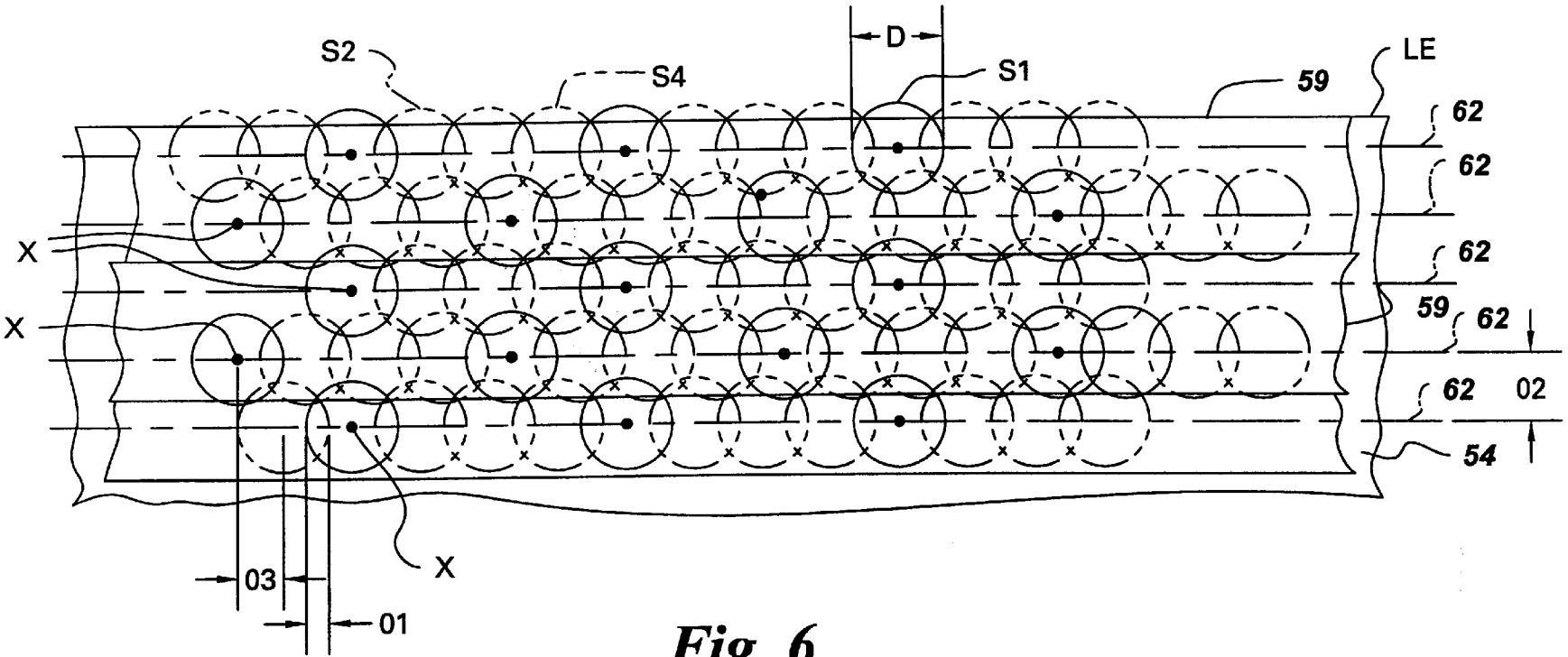
FIG. 6 is a schematic illustration of a particular pattern having four sequences of laser shock peen circular spots.

FIGS. 5 and 6 show patterns of laser circular spots that represent several sequences of laser firing. As illustrated, each circular spot 58 possesses a diameter D. In each row 64 of spots 58 that extend along a row centerline 62, the spots 58 are spaced apart from each other by a first offset "01". Adjacent rows of spots 58 are spaced apart from each other by a second offset "02". Further, the firing sequence of adjacent rows are spaced apart from each other by a third offset "03". Thus, a pattern of spots 58 covers portions of the ablative tape 59. The pattern of spots includes areas that may be irradiated two, three or four times. For example, "A" of FIG. 5 represents an area of the ablative tape 59 that was irradiated four times. The use of an ablative tape 59, as embodied by the invention, prevents such repetitively irradiated areas from deterioration.

These and other features will become apparent from the following detailed discussion, which by way of example without limitation describes preferred embodiments of the present invention.

EXAMPLE

Several samples were prepared and irradiated to determine the degree of penetration of a laser beam. Samples of pigmented ablative media in tape form were made starting with metallic and carbon pigments in commercial form—concentrates in resin pellets. The concentrates were melted and mixed with molten pellets of the desired un.pigmented polymer resin using a Brabender mixer. The polymer was a polypropylene. The ablative tapes were applied onto a substrate and irradiated. In the LSP procedure, two spots were hit on each sample. One spot was hit 4 times, and thus represents about two to four times the severity that a conventional ablative tape is expected to survive. The other spot was hit until the tape was visually judged to have failed, and this number of hits recorded. Compositions and results are given in TABLE 1.

TABLE 1

| Sample number | Sample Description | # of hits per spot |
|---|---|---|
| 1 | standard a | 4 |
| 2 | standard b | 4 |
| 3 | 3% C, no Al | 4 |
| | (all below are in PP) | |
| 4 | 6% C, no Al | 4 |
| 5 | 9% C, no Al | 4 |
| 6 | 3% Al, no C | 4 |
| 7 | 6% Al, no C | 4 |
| 8 | 9% Al, no C | 4 |
| 9 | 6% C, 3% Al | 4 |
| 10 | 3% C, 6% Al | 4 |
| 11 | 6% C, 6% Al | 4 |

In the TABLE, standard a and standard b are known tapes without metallic component. The results of the peening processes are summarized in FIG. 7. FIG. 7 is a chart of remaining tape thickness from the peening operations for the samples 1–11. The chart shows original tape thickness on the right axis and remaining tape thickness on the left axis, both in $\mu$m.

As indicated, ablative tapes as embodied by the invention, comprising at least one of aluminum or aluminum and carbon, provide desirable results by preserving tape thickness. The Example shows that an ablative medium according to the invention is suitable for preventing deterioration of an underlying substrate. The medium is also durable to repeated laser shocks. The medium prevents deterioration of the underlying substrate. This allows continuing peening and processing without requiring re-application of tape.

While preferred embodiments have been described, the present invention is capable of variation and modification and therefore should not be limited to the precise details of the Examples. The invention includes changes and alterations that fall within the purview of the following claims.

What is claimed is:

1. A tape comprising an ablative medium formulated to sustain repeated ablation hits by a laser in a laser shock peening process, wherein said ablative medium comprises a polymer and a dispersed component widely spread through said polymer, said dispersed component comprising from about 5 weight percent to about 8 weight percent aluminum and from about 4 weight percent to about 6 weight percent of an elemental form of carbon.

2. The tape of claim 1, wherein the metallic component comprises a metal in elemental form, alloy form or molecular form.

3. The tape of claim 1, wherein the metallic component is substantially opaque and capable of being ionized to a plasma.

4. The tape of claim 1, wherein the metallic component is elemental aluminum, an aluminum alloy or an aluminum compound.

5. The tape of claim 1, wherein the polymer is a thermoplastic polymer.

6. The tape of claim 1, wherein the polymer is a polyolefin.

7. The tape of claim 1, wherein the polymer is a polypropylene, polyethylene, or copolymer of at least one of polypropylene and polyethylene.

8. The tape of claim 1, additionally comprising an adhesive.

9. A method for treating a surface of a substrate, comprising steps of:

applying a tape onto a metallic substrate surface, the tape comprising an ablative medium comprising a polymer and dispersed metallic component; and irradiating the tape in a laser shock peening process to ablate the ablative medium to produce at least one shock wave that induces residual stresses in said metallic substrate.

10. The method of claim 9, wherein the step of irradiating the tape to ablate the ablative medium comprises irradiating the ablative tape using a laser.

11. The method of claim 9, wherein the substrate comprises a turbine part.

12. The method of claim 11, wherein the turbine component comprises a superalloy or titanum alloy.

13. The method of claim 12, wherein the superalloy is nickel-, cobalt-, or iron-based.

14. The method of claim 9, wherein the polymer comprises a thermoplastic polymer.

15. The method of claim 14, wherein the thermoplastic polymer comprises a polyolefin.

16. The method of claim 9, wherein the metallic component comprises a metal in elemental form, alloy form or molecular form.

17. The method of claim 9, wherein the ablative medium includes a non-metallic component.

18. The method of claim 9, wherein the metallic component is substantially opaque and capable of being ionized to a plasma.

19. The method of claim 9, wherein the metallic component is a pigment.

20. The method of claim 9, wherein the metallic component is selected from the group consisting of aluminum, magnesium, calcium, strontium, zinc, scandium, titanium, other transition metal elements, alloys thereof and compounds thereof.

21. The method of claim 9, wherein the metallic component is elemental aluminum, an aluminum alloy or an aluminum compound.

22. The method of claim 9, wherein the polymer is a thermoplastc polymer.

23. The method of claim 9, wherein the polymer is a polyolefin.

24. The method of claim 9, wherein the polymer is a polypropylene, polyethylene, or copolymer of at least one of polypropylene and polyethylene.

25. The method of claim 9, wherein the ablative medium comprises up to about 6 weight % of the metallic component.

26. The method of claim 9, wherein the ablative medium comprises carbon.

27. The method of claim 9, wherein the ablative medium comprises not less than about 1 weight % carbon.

28. The method of claim 9, wherein the ablative medium comprises an elemental form of carbon.

29. The method of claim 9, wherein the ablative medium comprises aluminum and carbon.

30. The method of claim 9, wherein the ablative medium comprises about 1 to about 15 weight % aluminum and about 1 to about 15 weight % carbon.

31. The method of claim 9, wherein the ablative medium comprises about 3 to about 10 weight % aluminum and about 3 to about 8 weight % carbon.

32. The method of claim 9, wherein the ablative medium comprises about 5 to about 8 weight % aluminum and about 4 to about 6 weight % carbon.

33. The method of claim 9, wherein the tape additionally comprises an adhesive.

34. The method of claim 9, wherein the step of irradiating the tape to ablate the ablative medium comprises irradiating by overlapping laser pulses.

35. The method of claim 9, wherein the step of irradiating the tape to ablate the ablative medium is conducted with a laser, and the step of irradiating the tape to ablate the ablative medium comprises irradiating through a confinement medium.

36. The method of claim 35, wherein the confinement medium comprises water.

37. The method of claim 35, wherein the confinement medium comprises a transparent layer.

38. The method of claim 9, wherein the ablative tape is adhered to the substrate by a layer of adhesive.

39. An article comprising a substrate and an ablative tape applied to said substrate, the ablative tape comprising an ablative medium formulated to sustain repeated ablation hits by a laser in a laser shock peening process, said ablative medium comprising a polymer and dispersed component widely spread through said polymer, wherein said dispersed component comprises from about 5 weight percent to about 8 weight percent aluminum and from about 4 weight percent to about 6 weight percent of an elemental form of carbon.

* * * * *